United States Patent [19]

Vertegaal

[11] 4,006,683

[45] Feb. 8, 1977

[54] ROTARY SCREEN PRINTING MACHINE

[75] Inventor: Jacobus Gerardus Vertegaal, Boxmeer, Netherlands

[73] Assignee: Stork Brabant B.V., Boxmeer, Netherlands

[22] Filed: Oct. 15, 1974

[21] Appl. No.: 515,027

[30] Foreign Application Priority Data

Oct. 31, 1973 Netherlands ..... 7314974

[52] U.S. Cl. ..... 101/118; 101/115

[51] Int. Cl.[2] ..... B41F 15/10; B41F 15/12

[58] Field of Search ..... 101/116, 118, 228, 115, 101/123, 124, 126; 26/51, 54 R; 226/44

[56] References Cited

UNITED STATES PATENTS

| | | | |
|---|---|---|---|
| 882,515 | 3/1908 | Birch | 26/51 X |
| 1,240,631 | 9/1917 | Trier | 26/54 X |
| 2,745,134 | 5/1956 | Collins | 226/44 X |
| 2,946,087 | 7/1960 | Haroldson et al. | 26/54 X |
| 3,313,232 | 4/1967 | Van der Winden | 101/118 |

FOREIGN PATENTS OR APPLICATIONS

| | | | |
|---|---|---|---|
| 2,112,025 | 9/1971 | Germany | 101/118 |

*Primary Examiner*—E. H. Eickholt
*Assistant Examiner*—R. E. Suter
*Attorney, Agent, or Firm*—Edmund M. Jaskiewicz

[57] ABSTRACT

A rotary screen printing machine comprising a travelling endless belt and at least one thin-walled cylindrical screen stencil for cooperating with the material to be printed which is supported upon the upper horizontal flight of said belt. A pressure roller and an elastical smoothing blade are arranged above the belt for cooperation with the material in an area lying before the first screen stencil.

3 Claims, 2 Drawing Figures

ROTARY SCREEN PRINTING MACHINE

BACKGROUND OF THE INVENTION

My invention relates to a rotary screen printing machine comprising a frame provided with means for driving and guiding an endless supporting belt along a path and with means for rotatably supporting a plurality of thin-walled cylindrical stencils along this path, means also being provided for feeding the band of material to be printed.

DISCUSSION OF THE PRIOR ART

Such a machine is known in various versions and described in e.g. the U.S. Pat. Nos. 3.291,044, 3,304,860, 3.313,232, 3,420,167, 3,718,086 and in the copending U.S. patent application Ser. No. 394,645 filed on Sept. 5, 1973 CIP of Ser. No. 108,384 now abandoned. These known machines are designed to print a textile web which is temporarily glued on the supporting belt in order to prevent the web from shifting with respect to the supporting belt on the printing path. After having passed by the last stencil the web is removed from the supporting belt and subsequently carried to a dryer. This printing technique has assumed enormous proportions since 1963 which marked the introduction of rotary screen printing machines for printing textile. For printing paper this technique has so far not been used and for that purpose it was necessary for one to rely on the conventional paper printing processes. It would, however, be advantageous if the rotary screen printing system could also be applied to paper in view of the advantages in the cost price, the production rate and the ease of interchanging the pattern to be printed.

In using a rotary screen printing machine for printing paper one was up to the present time confronted with various problems among which the most important are:

1. the required synchronisation between the rotary movement of the stencils and the advance of the paper band could not be realized by gluing the paper band on the supporting belt, since when the paper band is pulled loose from the supporting belt inevitably this band was damaged.

2. on being supplied in a taut condition a paper band always tends to form creases in the longitudinal direction. In the conventional paper printing apparatus this is prevented by using a plurality of rollers on which the paper band runs, but in a rotary screen printing machine these rollers cannot be positioned close enough to the effective area of each stencil.

SUMMARY OF THE INVENTION

It is an object of my invention to provide a rotary screen printing machine which offers a solution for both aforementioned problems. To attain this object a presser roller is situated in the part of the path of the supporting belt, situated before the first effective stencil, said roller being movable toward the belt, while in this first part of the path at least one thin elastic smoothing blade is arranged right over the belt.

Due to this combination of features it is in the first place ensured that the movement of the paper band on the one hand and of the supporting belt on the other hand are efficiently synchronized while the thin elastic smoothing blade can be arranged in the close vicinity of the printing area of the first stencil in order to prevent effectively the formation of creases.

My invention attempts moreover a break-through in the thus far existing prejudice against printing paper by means of the rotary screen printing system. It is true that so far machines for printing paper were known in which rotatable cylindrical thin walled stencils are used, but in that case always an extra drying interval is interposed between two consecutive stencils in order to ensure that the print of the preceding stencil is entirely dried before the paper band is admitted to the next stencil. In case of textile printing such an intermediate drying is superfluous because the fibrous material absorbs the dye sufficiently so that no difficulties are experienced at the next stencil. Surprisingly it has been found that now the rotary screen printing machine as used in textile printing after using the aforementioned measures is adapted to printing a paper band. There is, however, a minor transfer of dye from a preceding stencil to a next stencil, but an equilibrium is quickly attained and in this situation the print measures up to a standard, which in practice is acceptable.

My invention is particularly of importance for the recently developing transfer printing, that is to say a printing process for textile wherein a pre-printed paper band is used to transfer via the transfer process a pattern to the textile web. This transfer system has the advantage as compared with the conventional rotary screen printing for textile that the production rate is very high. Further it is no longer necessary for the manufacturer to have designed stencils in stock and it will be sufficient for him to buy a paper band which has been previously printed with the desired design. My invention permits such paper bands to be rapidly manufactured at a low price.

SURVEY OF THE DRAWINGS

DESCRIPTION OF A PREFERRED EMBODIMENT

Figures 1, 2:
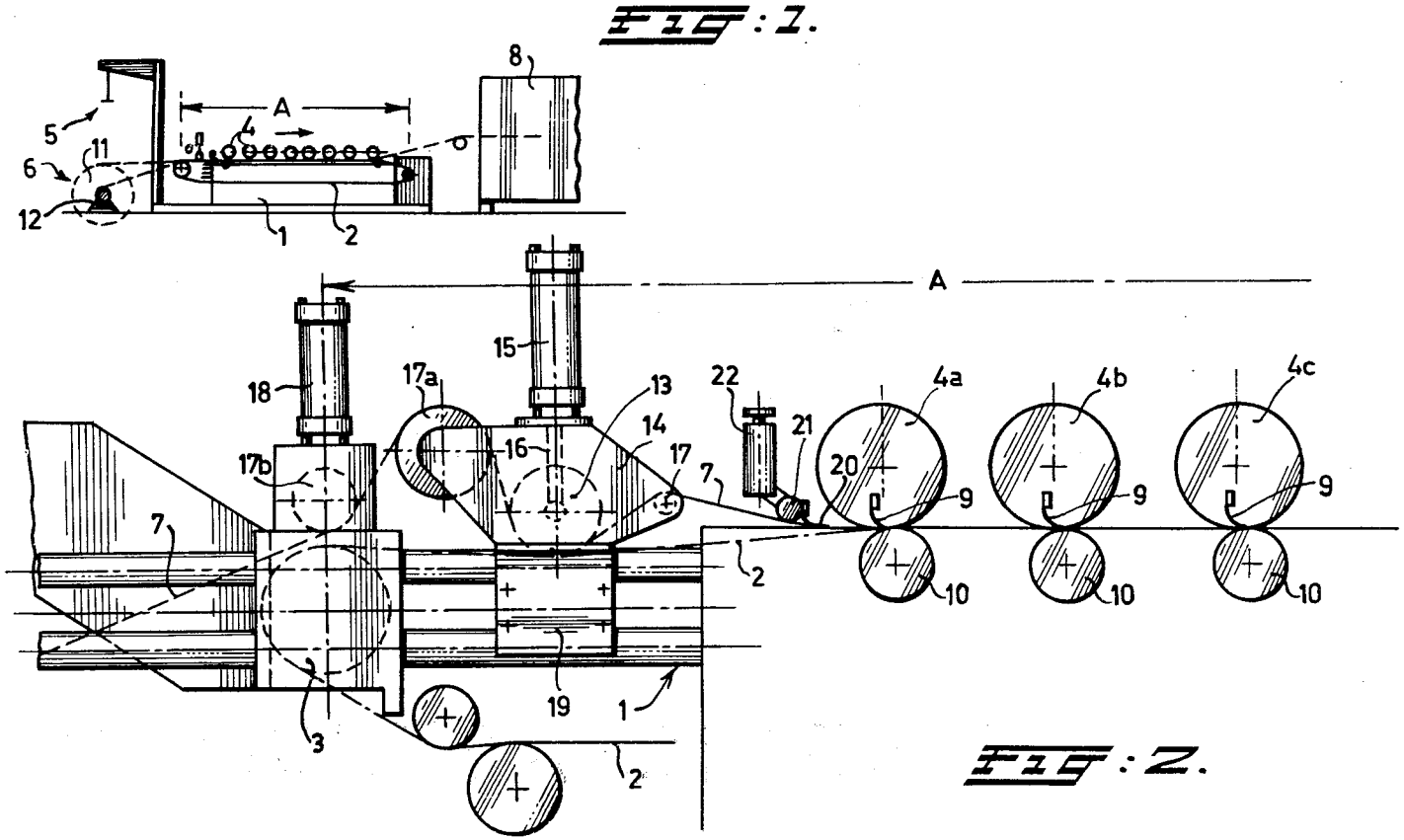
FIG. 1 is a front view on a reduced scale of the machine according to the invention.
FIG. 2 is a side elevation of the most essential part of this machine.

The construction of the machine is substantially conventional in conformity with the aforementioned U.S. Pat. Nos. 3,291,044, 3,304,860, 3,313,232 and 3,420,167, according to which a frame 1 is provided with means (here not shown) for driving and guiding an endless supporting belt 2 on a path A which is substantially constituted by the upper part of the supporting belt 2, which is situated between two guide rollers 3. The frame 1 is furthermore provided with means for rotatably supporting a plurality of thin-walled cylindrical stencils 4 *a*, *b*, *c* . . . arranged along this path A. Means 5 and 6 are also disposed for feeding a band 7 of material to be printed. Those means 5 are only partially represented in FIG. 1 since they constitute a conventional provision for supplying a textile web.

Beyond the righthand end of the path A a device 8 is provided for drying the printed band 7. The stencils 4 are each provided with a inner squeegee 9, while each stencil at the location of this squeegee 9 can cooperate with the band 7 which bears on the supporting belt 2. Along the underside of the upper part of the supporting belt 2 as many supporting rollers 10 are arranged as there are stencils 4 on the path A. So far the arrangement of the machine corresponds with the usual rotary screen printing machines for textile printing.

The provision according to my invention which enables use of this known type of machine for printing a paper band is provided in the part of the track A of the supporting belt 2, which is situated before the first effective stencil 4*a*. This part of tract A is represented on a larger scale in FIG. 2, the paper band 7 coming from a roll 11 shown in FIG. 1. The means 6 for feeding the paper band 7 consist of a stand 12 upon which is mounted roll 11.

This further structure consists in the first place of a presser roller 13, movable toward the belt 2, which is received in a supporting yoke 14 provided with a pneumatic cylinder 15 the piston rod 16 of which is connected with the roller 13. In the yoke 14 and on either side of the roller 13 rollers 17 and 17*a* are supported for guiding the paper band 7 in such a manner that the first contact of this band 7 with the supporting belt 2 is only effected in the contact area between the roller 13 and the belt 2. Over the lefthand guide roller 3 for the supporting belt 2 a third roller 17*b* is provided and a pneumatic cylinder 18 for pressing downwardly said roller 17*b*. The supporting yoke 14 is secured on the frame 1 by means of a plate 19.

A thin elastic smoothing blade 20 is arranged right over the belt 2 and in the part of the path A of the supporting belt, which is situated before the first effective stencil 4. Each smoothing blade 20 is secured on a supporting pipe 21 which on its turn is secured on an adjustment device 22 which is connected with the frame 1 of the machine.

As is shown in FIG. 2 the presser roller 13 is effective in a yielding area of the supporting belt 2. This situation arises due to the fact that at this location no supporting roller like the rollers 10 is lying under the stencils 4. The pressure of the roller on the supporting belt 2 can be determined by means of the pneumatic cylinder 15 whereby the paper band 7 is clamped along a small angle of arc between the roller 13 on the one hand and the supporting belt 2 on the other hand. As a consequence, the paper band 7 moves with a velocity which is equal to the rate of advance of the belt 2, which velocity on its turn is tuned to the speed of rotation of the stencils 4, e.g. as disclosed in the U.S. Pat. No. 3,420,167.

The elements 13–19 described permit the paper band 7 to be passed at the desired rate past the stencils 4 without causing this band to adhere to the supporting belt 2 as previously was the case on printing a textile web. The elements 20–22 ensures that no creases will form in the longitudinal direction of the paper band 7 by first smoothing the band of material and then pressing the band on the supporting belt. This formation of creases is a sympton which often occurs when such a band is supplied under a certain tension. These two structures allow use of the ramainder of a conventional rotary screen textile printing machine for printing a paper band.

What I claim is:

1. In a rotary screen printing machine, a frame, means on said frame for driving and guiding an endless supporting belt along a path, means on said frame for rotatably supporting a plurality of thin-walled cylindrical screen stencils along said path, means for feeding a band of material to be printed onto the path of said supporting belt before the first of said plurality of stencils, a presser roller in said supporting belt path before said first stencil to press said band of material upon said supporting belt to synchronize the movement of said band and said supporting belt, means for moving said presser roller toward and away from said belt, a supporting roller spaced above said belt between said presser roller and said first stencil and said band passing over said supporting roller, and a thin resilient smoothing blade positioned above said belt between said supporting roller and said first stencil in the close vicinity of the printing area of said first stencil, said blade acting upon said band, said blade first smoothing the band of material and thereupon pressing said band on the supporting belt to prevent the formation of creases in the longitudinal direction of said band as the band and belt are possed beneath said first stencil.

2. In a rotary screen printing machine according to claim 1 wherein said moving means comprises a supporting yoke and said presser roller is movable toward and away from said belt, said supporting roller being journalled on one side of said supporting yoke, and a third roller journalled on the other side of said yoke for guiding the band of material.

3. In a rotary screen printing machine according to claim 2, in which the presser roller and blade are acting upon an unsupported yielding area of the supporting belt.

* * * * *